United States Patent [19]

Anderson

[11] 4,246,963

[45] Jan. 27, 1981

[54] HEAT EXCHANGER

[75] Inventor: Alexander F. Anderson, Los Angeles, Calif.

[73] Assignee: The Garrett Corporation, Los Angeles, Calif.

[21] Appl. No.: 955,273

[22] Filed: Oct. 26, 1978

[51] Int. Cl.[3] ..... F28F 3/00

[52] U.S. Cl. ..... 165/166; 138/32; 29/157.3 D; 29/157.4

[58] Field of Search ..... 165/134, 166; 138/32; 62/80; 29/157.3 D, 157.4

[56] References Cited

U.S. PATENT DOCUMENTS

| | | |
|---|---|---|
| Re. 17,973 | 2/1931 | Mosher . |
| 1,833,166 | 11/1931 | Lucke . |
| 2,715,520 | 8/1955 | Boyce . |
| 2,959,401 | 11/1960 | Burton . |
| 2,985,433 | 5/1961 | Simpelaar . |
| 3,451,473 | 6/1969 | Urie et al. . |
| 3,601,185 | 8/1971 | Rothman . |
| 3,727,681 | 4/1973 | Fernandes . |
| 3,825,061 | 7/1974 | Bathia . |

*Primary Examiner*—George T. Hall

*Attorney, Agent, or Firm*—Albert J. Miller; Joel D. Talcott; Joseph A. Yanny

[57] ABSTRACT

A plate-fin heat exchanger for transferring heat energy between heated air and relatively cold air, including elongated rounded surface hollow header bars traversing the cold air inlet for passing a portion of the hot air thereacross to prevent excessive ice formation.

24 Claims, 3 Drawing Figures

HEAT EXCHANGER

BACKGROUND OF THE INVENTION

This invention relates to heat exchangers for transferring heat energy between hot and cold working fluids. More specifically, this invention relates to a plate-fin type heat exchanger including means for preventing excessive ice formation at the cold fluid inlet.

In the prior art, plate-fin heat exchangers are well known, and typically comprise a plurality of plates arranged in an alternating stack with extended surface heat transfer elements such as fins or the like. The extended surface fins in the stack are commonly turned alternately at right angles with respect to each other to form closely adjacent flow paths for passage of two working fluids at right angles to each other. This construction is commonly known as a cross-flow heat exchanger, and includes appropriate header bars for isolating the two flow paths from each other together with manifolding for supplying the fluids to their respective flow paths.

A major problem in the design of plate-fin heat exchangers occurs when the cold working fluid is supplied to the heat exchanger at a temperature below the freezing point of water, and the cold fluid includes substantial quantities of entrained water. This problem is prevalent in heat exchangers used on aircraft environmental control systems because of the low air temperatures encountered at high altitudes, or when control system air expanded through a turbine for cooling is supplied to a heat exchanger such as a condensing heat exchanger. Importantly, these types of plate-fin heat exchangers are relatively compact in size, and thus experience an undesirable tendency to collect ice at the cold air inlet face of the unit. Ice formation blocks off fluid flow, and thereby substantially and undesirably reduces the efficiency and operability of the unit.

This invention overcomes the problems and disadvantages of the prior art by providing an improved plate-fin heat exchanger including means for maintaining the temperature of the heat exchanger cold air inlet face at a sufficient level to prevent ice formation.

SUMMARY OF THE INVENTION

In accordance with the invention, a heat exchanger comprises a plurality of extended surface heat transfer or fin elements arranged in stacked relation to form a pair of working fluid flow paths for passage of a pair of working fluids, such as hot and cold air, in close heat exchange relation. The flow paths are isolated from each other by header bars at the inlet and outlet ends of each flow path to prevent intermixing of the two fluids. Importantly, hollow header bars at the cold fluid inlet end of the heat exchanger have a generally rounded configuration convexly presented toward the incoming cold fluid, and are open to flow of a portion of the hot fluid transversely across the cold fluid inlet to prevent excessive ice formation.

BRIEF DESCRIPTION OF THE DRAWINGS

The accompanying drawings illustrate the invention. In such drawings.

DETAILED DESCRIPTION OF THE PREFERRED EMBODIMENT

Figure 1:
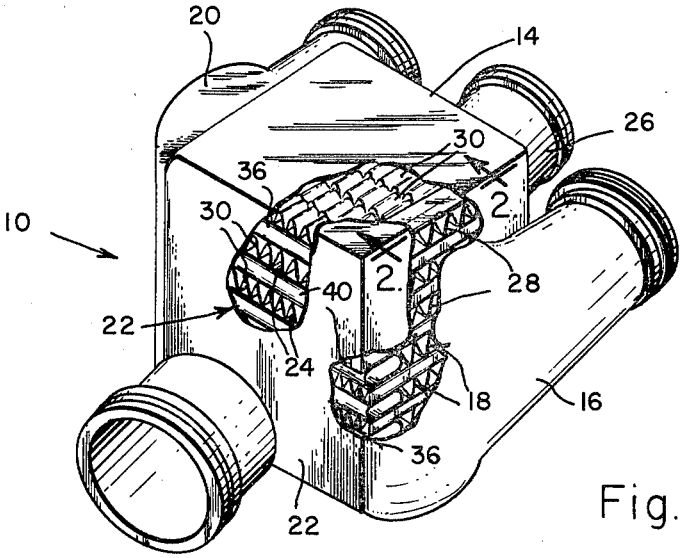
FIG. 1 comprises a perspective view of a heat exchanger of this invention, with portions broken away.

A heat exchanger 10 of this invention is shown in FIG. 1, and generally comprises a plate-fin heat exchanger core 12 carried within a housing 14. The housing includes an inlet manifold 16 configured for receiving a heated working fluid, such as hot air, and for directing the hot fluid through a plurality of passages 18 defining a hot fluid flow path to an outlet manifold 20. A relatively cold working fluid, such as cold air, is supplied through a second inlet manifold 22 for passage through the core 12 via a plurality of passages 24 defining a cold fluid flow path to a second outlet manifold 26.

The heat exchanger 10 shown in FIG. 1 may comprise a condensing heat exchanger of the type illustrated schematically and described in U.S. patent application Ser. No. 921,660, filed July 3, 1978, and assigned to the same assignee as this application. Specifically, the cold air supplied to the cold air inlet manifold 22 comprises cold air which has been expanded through the cooling turbine of an environmental control unit, or alternately, comprises cold air having a temperature level below the freezing point of water. Importantly, in many applications, this cold air includes entrained water particularly in the form of ice crystals, and in aircraft environmental control units may have a temperature of as low as about −50° F. This cold air is heated in the heat exchanger 10, and ducted through the cold air outlet manifold 26 for use such as in an environmental space, for example, the cabin area of an aircraft.

Figure 2:
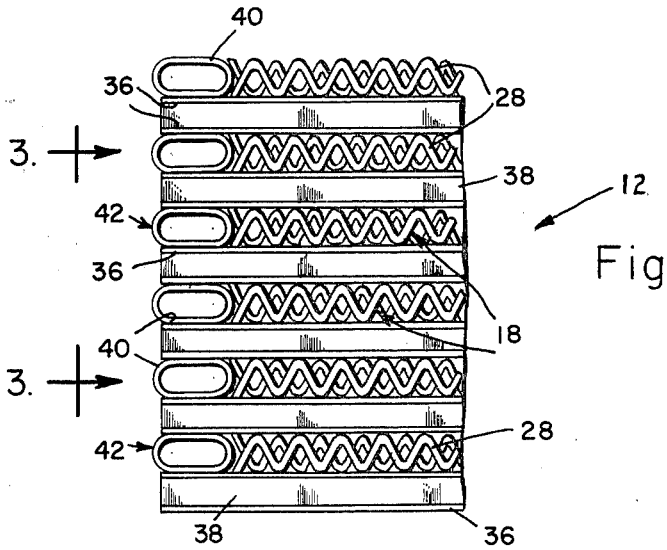
FIG. 2 comprises an enlarged fragmented section taken on a line 2—2 of FIG. 1.
Figure 3:
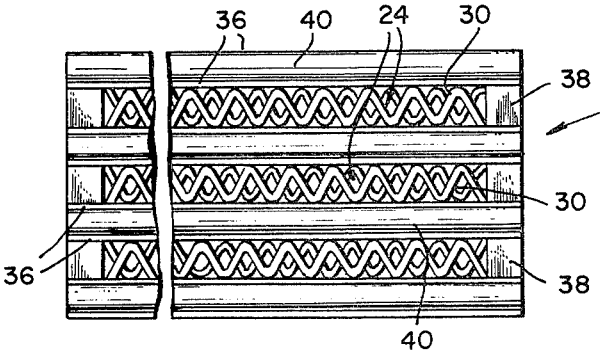
FIG. 3 comprises a fragmented elevation view of a portion of the heat exchanger taken on the line 3—3 of FIG. 2.

The core 12 of the heat exchanger 10 is shown in more detail in FIGS. 2 and 3. As shown, the core 12 comprises a laminated alternating stack of extended surface heat transfer or fin elements 28 and 30 arranged at right angles with respect to each other to form the passages 18 and 24, respectively, defining the fluid flow paths. These heat transfer elements 28 and 30 are substantially identical, and each comprises a generally corrugated fin-like member facing the associated inlet manifold 16 or 22. A plurality of additional extended surface elements 28 or 30 extend in an offset staggered relation toward the associated outlet manifold 20 or 26 to complete the flow path passages 18 or 24, as viewed in FIG. 1. Importantly, the alternately stacked heat transfer elements 28 and 30 are separated by relatively thin heat transfer plates 36, with the entire assembly being connected together as by brazing to form a rigid heat exchanger core 12. In this manner, the core 12 comprises a cross-flow type heat exchanger with the heat transfer elements defining the flow path passages 18 and 24 for passage of the hot and cold air in close heat transfer relation with each other.

Intermixing of the hot and cold air within the housing 14 or the core 12 is prevented by a plurality of header bars 38 and 40 at the inlet and outlet ends of both flow paths through the core. More specifically, the header bars 38 are formed from solid bar stock or the like having a square cross section as shown, and are secured in position as by brazing or other suitable techniques. The header bars 38 extend transversely across the hot air inlet end of the core 12 adjacent the hot air inlet manifold 16, and in parallel relation with and alongside the cold air heat transfer elements 30. In this manner, the header bars 38 block the hot air from passage through the cold air flow path passages 24, and thus confine the hot air for passage only through the hot air flow path passages 18. In the same manner, the solid header bars 38 extend transversely across the hot air outlet alongside the cold air heat transfer elements 30 and adjacent the hot air outlet manifold 20, and transversely across the cold air outlet alongside the hot air heat transfer elements 28 and adjacent the cold air outlet manifold 26 for preventing mixing at those locations between the hot and cold air.

The header bars 40 extend transversely across the cold air inlet adjacent the cold air inlet manifold 22. These header bars 40 have a hollow tubular configuration with a generally rounded surface 42 convexly presented toward the incoming cold air. The hollow bars 40 extend in parallel with and alongside the hot air heat transfer elements 28, and are secured in position as by brazing or the like to block flow of cold air through the hot air flow path passages 18. Importantly, these hollow header bars 40 are in flow communication with the hot air inlet and outlet manifolds 16 and 20, and thus pass a portion of the hot air across the cold air inlet face of the heat exchanger 10.

In operation, the hollow header bars 40 are sized to provide a relatively enlarged flow area compared to the hot air flow path passages 18, and have an exterior surface configuration for preventing excess ice formation at the cold air inlet face of the heat exchanger. That is, the hollow bars 40 are sized to pass, for example, say about 5% to 10% of the total hot air flow whereby the cold air inlet face of the heat exchanger 10 is maintained at a temperature substantially above the temperature of the incoming cold air. This relative heating at the cold air inlet face, together with the convex rounded surfaces 42 of the header bars 40, tends to cause rapid melting, dislodging, and breaking off of any ice particles or crystals which may form or collect on the cold air inlet face. In this manner, the header bars 40 provide temperature control to prevent ice formation and thus maintain operating efficiency of the heat exchanger.

A variety of modifications and improvements of the invention are believed to be possible without varying from the scope of the invention. For example, the cross sectional area of the hollow header bars 40, and thus the percentage flow capacity of the header bars 40 may be adjusted according to the design requirements of a particular heat exchanger. Accordingly, no limitation of the invention is intended by way of the description of the preferred embodiment herein, except by way of the appended claims.

What is claimed is:

1. A heat exchanger comprising a core formed from a plurality of heat transfer elements defining first and second fluid flow paths with inlet and outlet ends for passage of a pair of fluids in heat exchange relation; manifold means for directing a relatively hot fluid for passage through said first flow path and for directing a relatively cold fluid for passage through said second flow path; and temperature control means for passing a portion of the hot fluid transversely across the inlet end of said second flow path for sufficiently maintaining the temperature level at said second flow path inlet end to prevent excessive ice formation.

2. A heat exchanger as set forth in claim 1 wherein said temperature control means comprises a hollow tube communicating between the inlet and outlet ends of said first flow path for passage of a portion of the hot fluid.

3. A heat exchanger as set forth in claim 2 wherein said hollow tube has a generally rounded surface configuration convexly presented toward incoming cold fluid at the inlet end of said second flow path.

4. A heat exchanger as set forth in claim 1 wherein said temperature control means comprises a plurality of hollow tubes communicating between the inlet and outlet ends of said first flow path.

5. A heat exchanger as set forth in claim 1 wherein said cold fluid comprises relatively cold air having a temperature level below the freezing point of water.

6. A heat exchanger as set forth in claim 1 wherein said core comprises a plurality of heat transfer elements arranged in an alternating stack with a plurality of relatively thin plates to form a plate-fin heat exchanger core with said heat transfer elements forming a plurality of relatively small passages defining said first and second flow paths; and first header bars at the inlet and outlet ends of said first flow path, and at the outlet end of said second flow path for preventing intermixing between the hot and cold fluids, said temperature control means comprising hollow header bars at the inlet end of said second flow path for preventing intermixing between the hot and cold fluids, and for communicating between the inlet and outlet ends of said first flow path for passing a portion of the hot fluid.

7. A heat exchanger as set forth in claim 6 wherein said hollow header bars each have a generally rounded surface configuration convexly presented toward incoming cold fluid at the inlet end of said second flow path.

8. A heat exchanger comprising a core formed from a plurality of heat transfer elements defining first and second flow paths with inlet and outlet ends for passage of a pair of fluids in heat transfer relation; manifold means for directing a relatively hot fluid for passage through said first flow path and for directing a relatively cold fluid for passage through said second flow path; and temperature control means comprising a hollow tube communicating between the inlet and outlet ends of said first flow path and extending transversely across the inlet end of said second flow path for passing a portion of the hot fluid thereacross for maintaining the temperature level of said second flow path inlet end sufficiently to prevent ice formation.

9. A heat exchanger as set forth in claim 8 wherein said cold fluid comprises relatively cold air having a temperature level below the freezing point of water.

10. A heat exchanger as set forth in claim 8 wherein said core comprises a plurality of heat transfer elements arranged in an alternating stack with a plurality of relatively thin plates to form a plate-fin heat exchanger core with said heat transfer elements forming a plurality of relatively small passages defining said first and second flow paths; and first header bars at the inlet and outlet ends of said first flow path, and at the outlet end of said second flow path for preventing intermixing between the hot and cold fluids, said temperature control means comprising hollow header bars at the inlet end of said second flow path for preventing intermixing between the hot and cold fluids, and for communicating between the inlet and outlet ends of said first flow path for passing a portion of the hot fluid.

11. A heat exchanger as set forth in claim 10 wherein said hollow header bars each have a generally rounded surface configuration convexly presented toward incoming cold fluid at the inlet end of said second flow path.

12. A heat exchanger comprising a plurality of heat transfer elements arranged in an alternating stack with a plurality of relatively thin plates to form a plate-fin heat exchanger core with said heat transfer elements forming a plurality of relatively small passages defining first and second flow paths for passage of a pair of fluids in heat exchange relation; manifold means for directing a relatively hot fluid for passage through said first flow path and for directing a relatively cold fluid for passage through said second flow path; first header bars at the inlet and outlet ends of said first flow path, and at the outlet end of said second flow path for preventing intermixing between the hot and cold fluids; and hollow header bars at the inlet end of said second flow path for preventing intermixing between the hot and cold fluids, and for communicating between the inlet and outlet ends of said first flow path for passing a portion of the hot fluid transversely across the inlet end of said second flow path for sufficiently maintaining the temperature level at said second flow path inlet end to prevent excessive ice formation.

13. A heat exchanger as set forth in claim 12 wherein said hollow header bars each have a generally rounded surface configuration convexly presented toward incoming cold fluid at the inlet end of said second flow path.

14. In a heat exchanger having a core formed from a plurality of heat transfer elements defining first and second flow paths with inlet and outlet ends for passage respectively of a relatively hot fluid and a relatively cold fluid, means for preventing excessive ice formation at the inlet end of said second flow path comprising a hollow tube extending transversely across said second flow path inlet end and communicating between the inlet and outlet ends of said first flow path for passing a portion of the hot fluid across said second flow path inlet end to maintain the temperature level thereat sufficiently to prevent excess ice formation.

15. The invention of claim 14 wherein said tube has a generally rounded surface configuration convexly presented toward incoming cold fluid at said second flow path inlet end.

16. A method of forming a heat exchanger comprising the steps of forming a heat exchanger core from a plurality of heat transfer elements defining first and second fluid flow paths with inlet and outlet ends for passage respectively of a relatively hot fluid and a relatively cold fluid; and mounting a hollow tube transversely across the inlet end of the second flow path and in communication with the inlet and outlet ends of the first flow path for passing a portion of the hot fluid across the second flow path inlet end to prevent excessive ice formation at said second low path inlet end.

17. The method of claim 16 including the step of forming the hollow tube to have a generally rounded surface configuration convexly presented toward incoming cold fluid at the second flow path inlet end.

18. A method of forming a heat exchanger comprising the steps of forming a heat exchanger core from a plurality of heat transfer elements arranged in an alternating stack with a plurality of relatively thin plates defining a plurality of relatively small passages forming first and second flow paths for passage respectively of a relatively hot fluid and a relatively cold fluid; mounting first header bars at the inlet and outlet ends of said first flow path, and at the outlet end of said second flow path for preventing intermixing between the hot and cold fluids; and mounting hollow header bars at the inlet end of said second flow path for preventing intermixing between the hot and cold fluids, and for communication between the inlet and outlet ends of said first flow path for passing a portion of the hot fluid transversely across the inlet end of the second flow path for sufficiently maintaining the temperature level thereat to prevent excessive ice formation.

19. The method of claim 18 including the step of forming the hollow header bars each to have a generally rounded surface configuration convexly presented toward incoming cold fluid at the second flow path inlet end.

20. In a heat exchanger having a core formed from a plurality of heat transfer elements defining first and second flow paths with inlet and outlet ends for passage respectively of a relatively hot fluid and a relatively cold fluid, a method of preventing excessive ice formation at the inlet end of the second flow path comprising the steps of mounting a hollow tube to extend transversely across the inlet end of the second flow path, and to communicate between the inlet and outlet ends of said first flow path, and passing a portion of the hot fluid through said tube to maintain the temperature level at the second flow path inlet end sufficiently to prevent excessive ice formation.

21. In a heat exchanger having a core formed from a plurality of heat transfer elements defining first and second flow paths with inlet and outlet ends for passage respectively of a relatively hot fluid and a relatively cold fluid, and a hollow tube extending transversely across the inlet end of the second flow path, a method of preventing excessive ice formation at the inlet end of the second flow path comprising passing a portion of the hot fluid through said tube to maintain the temperature level at the second flow path inlet end sufficiently to prevent excessive ice formation.

22. The method of claims 20 or 21 including the step of forming the hollow tube to have a generally rounded surface configuration convexly presented toward incoming cold fluid at the second flow path inlet end.

23. A method of transferring heat energy between a relatively hot fluid and a relatively cold fluid including entrained water, comprising the steps of forming a heat exchanger core from a plurality of heat transfer elements defining first and second flow paths with inlet and outlet ends for passage respectively of the hot fluid and the cold fluid; mounting a hollow tube transversely across the inlet end of the second flow path in communication with the inlet and outlet ends of the first flow path; and passing a portion of the hot fluid through the hollow tube to prevent excessive ice formation at the second flow path inlet end.

24. The method of claim 23 including the step of forming the hollow tube to have a generally rounded surface configuration convexly presented toward incoming cold fluid at the second flow path inlet end.

* * * * *